US012006776B2

(12) United States Patent
Amorim et al.

(10) Patent No.: US 12,006,776 B2
(45) Date of Patent: Jun. 11, 2024

(54) INSTALLATION OF SUBSEA RISERS

(71) Applicant: Subsea 7 do Brasil Servicos Ltda, Niteroi (BR)

(72) Inventors: Andre Ramiro Amorim, Rio de Janeiro (BR); Davi Couto Neves Junior, Niteroi (BR); Alberto Lima Dos Santos, Niteroi (BR); Mauricio Suarez de Oliveira, Rio de Janeiro (BR)

(73) Assignee: SUBSEA 7 DO BRASIL SERVICOS LTDA, Niterói (BR)

( * ) Notice: Subject to any disclaimer, the term of this patent is extended or adjusted under 35 U.S.C. 154(b) by 0 days.

(21) Appl. No.: 17/604,291

(22) PCT Filed: Apr. 15, 2020

(86) PCT No.: PCT/BR2020/050130
§ 371 (c)(1),
(2) Date: Oct. 15, 2021

(87) PCT Pub. No.: WO2020/210887
PCT Pub. Date: Oct. 22, 2020

(65) Prior Publication Data

US 2022/0195809 A1 Jun. 23, 2022

(30) Foreign Application Priority Data

Apr. 16, 2019 (GB) ..... 1905382

(51) Int. Cl.
*E21B 17/01* (2006.01)
*B63B 35/03* (2006.01)
(Continued)

(52) U.S. Cl.
CPC ..... *E21B 17/012* (2013.01); *B63B 35/03* (2013.01); *E21B 17/015* (2013.01); *E21B 19/004* (2013.01); *E21B 43/0107* (2013.01)

(58) Field of Classification Search
CPC .... E21B 17/012; E21B 17/015; E21B 19/004; E21B 43/0107; B63B 35/03
(Continued)

(56) References Cited

U.S. PATENT DOCUMENTS 7,748,464 B2 * 7/2010 Bhat ..... B63B 21/502 405/224.4
8,316,947 B2 * 11/2012 Sack ..... E21B 43/01 166/85.1
(Continued)

FOREIGN PATENT DOCUMENTS

WO 2011/099869 A2 8/2011
WO WO 2015/074687 5/2015
(Continued)

OTHER PUBLICATIONS

Det Norske Veritas Offshore Standard DNV-OS-F201, "Dynamic Risers" (2001).

*Primary Examiner* — Matthew Troutman
*Assistant Examiner* — Patrick F Lambe
(74) *Attorney, Agent, or Firm* — MATTINGLY & MALUR, PC

(57) ABSTRACT

A method of installing a wave-configuration subsea riser of unbonded flexible pipe comprises lowering the riser progressively into the sea from an installation vessel while suspending an elongate clump weight in a catenary shape that comprises first and 5 second limbs extending upwardly from a conjoining bottom portion. An upper end of the first limb, at a distal end of the clump weight, is attached to the riser and an upper end of the second limb, at a proximal end of the clump weight, is suspended from a winch or crane of
(Continued)

the vessel. While lowering the riser from the vessel, the weight load applied to the riser by the clump weight is controlled by adjusting the relative lengths of the first 0 and second limbs of the clump weight.

15 Claims, 10 Drawing Sheets

(51) Int. Cl.
*E21B 19/00* (2006.01)
*E21B 43/01* (2006.01)

(58) Field of Classification Search
USPC ..... 166/350
See application file for complete search history.

(56) References Cited

U.S. PATENT DOCUMENTS

| | | | | |
|---|---|---|---|---|
| 9,976,363 | B2 | 5/2018 | Kristoffersen et al. | |
| 10,119,371 | B2 | 11/2018 | Kistoffersen et al. | |
| 2005/0063788 | A1* | 3/2005 | Clausen | E21B 17/015 405/224.2 |
| 2011/0274501 | A1 | 11/2011 | Remery et al. | |
| 2015/0047852 | A1* | 2/2015 | Pionetti | E21B 17/085 166/350 |

FOREIGN PATENT DOCUMENTS

| | | | |
|---|---|---|---|
| WO | WO 2015/192899 | | 12/2015 |
| WO | 2017/095228 | A1 | 6/2017 |
| WO | 2017/095229 | A1 | 6/2017 |

* cited by examiner

INSTALLATION OF SUBSEA RISERS

This invention relates to the installation of subsea risers. The invention relates particularly to installing risers that have an intermediate reverse-curvature profile defining a hogbend, such as lazy-wave risers. The invention addresses the need to simplify and quicken the installation of such risers, especially where a clump weight is used in conjunction with buoyancy to impart the desired hogbend shape during installation.

A subsea riser connects a pipeline on the seabed to the surface for transporting fluids between those locations. In particular, production fluids containing oil and/or gas flow up the riser to a surface installation such as a platform or a floating production, storage and offloading (FPSO) vessel. Reciprocally, other fluids such as water or chemicals may flow down the riser in one or more parallel pipes to support subsea oil and gas production. Power and data cables may also extend along the riser to power, control and monitor subsea installations.

Several riser architectures or configurations are known in the art and described in standards adopted by the subsea oil and gas industry, for example in DNV (Det Norske Veritas) Offshore Standard DNV-OS-F201 entitled *Dynamic Risers*. The selection of a riser configuration involves a trade-off between various factors, notably: catenary weight; sea dynamics, including currents; fatigue; materials; water depth; installation method; flowrate; and, of course, cost.

A riser in the form of a free-hanging catenary is the simplest, least expensive and easiest riser configuration to install. However, in deep water, the top tension is high due to the length and hence the weight of the riser that is suspended between the surface and the seabed. Also, a free-hanging catenary is susceptible to damage due to motion of the supporting vessel or platform, driven by sea dynamics. The risk of damage is especially great around the touch-down point or TDP of the riser, between the suspended portion of the riser and the remainder of the riser that lies on the seabed.

For these reasons, an S-configuration or wave-configuration riser is preferred in some situations. In each case, a portion of the riser is lifted at an intermediate location between the seabed and the surface to adopt an upwardly-facing convex reversed curvature that defines a hogbend. The intermediate support applied to the hogbend reduces the top tension and helps to decouple the TDP of the riser from motion of the supporting vessel or platform.

S-configuration risers are characterised by a subsea arch or buoy that is anchored to the seabed to support the hogbend. In a lazy-S configuration, a riser is not restrained at the TDP whereas in a steep-S configuration, a riser is restrained at the TDP by a subsea base structure.

Conversely, wave-configuration risers support the hogbend with buoyancy attached to the riser. Buoyancy is added by attaching a series of buoyancy modules along a substantial length of the riser to modify the curvature of the riser and hence to define the shape, size and position of the hogbend. Optionally, weight may be added permanently or temporarily to the riser at either or both ends of the hogbend to achieve a desired waveform shape.

Analogously to S-configuration risers, a riser with a lazy-wave configuration is not restrained at the TDP whereas a riser with a steep-wave configuration is restrained at the TDP by a subsea base structure. A pliant-wave configuration is also known, in which a subsea anchor controls the TDP.

Thus, unlike a steep-wave configuration, tension in a pliant-wave riser is transferred to the anchor and not to a subsea base structure at the TDP.

In principle, S-configurations or wave configurations could be adopted for rigid risers fabricated from steel pipe or made of reinforced-polymer composite materials. However, S-configurations or wave configurations are preferably adopted for flexible risers made of flexible pipe. Advantageously, S-configurations or wave configurations reduce the stress and fatigue to which a flexible pipe is particularly susceptible.

Whilst rigid risers have flexibility to bend along their length, they must not be confused with risers of flexible pipe as that term is understood in the art. Unbonded flexible pipe (often abbreviated simply as flexible pipe) is characterised by a layered composite structure that comprises polymer layers and a steel carcass or armour layers. Flexible pipe has an advantageously small minimum bend radius (MBR) but if that MBR is exceeded, the pipe wall will fail irreparably. Flexible pipe is also vulnerable to failure under compressive loads.

The complexity of installing S-configuration risers means that wave-configuration risers are preferred where possible, assuming that a simpler free-hanging catenary is not practical.

A drawback of wave-configuration risers arises during their installation, in particular when facing the challenge of forcing or initiating the appearance of the hogbend without overbending and stressing the flexible pipe. In this respect, the flexible pipe is light and easily deflected when immersed in seawater, especially when supported by buoyancy modules. It is therefore necessary to control the pipe against unwanted movement and deflection driven by buoyant upthrust and by sea dynamics. It is particularly important to avoid compressive loads in the pipe beneath the tensioner of the installation vessel that applies hold-back tension to the pipe. This is done by temporarily attaching at least one clump weight to the submerged pipe. The clump weight typically comprises lengths of heavy chain or wire, for example a bundle of mooring chains.

A conventional installation method for a wave-configuration flexible riser is summarised in the flow diagram of FIG. 1. The method involves, at 10, launching a catenary of flexible pipe by progressively unspooling and launching the pipe into the sea. At 12, a determination is made that a sufficient length of the pipe has been launched into the sea. Then, at 14, buoyancy modules are mounted at intervals along the pipe in positions corresponding to the desired hogbend. The pipe is lowered with a catenary shape until, at 16, it is determined that the leading buoyancy modules are underwater. Then, at 18, a clump weight is lowered into the water on a lifting wire, connected to a collar on the pipe beneath the leading buoyancy modules at 20 and disconnected from the lifting wire at 22 so that its full weight is suspended from the pipe. The clump weight offsets the upthrust of the pipe and the buoyancy modules to hold the pipe in a steeply-inclined catenary shape as installation progresses further at 24.

When the installation process is nearly complete and the correct location and shape of the hogbend is ready to be achieved, the clump weight is reconnected to a lifting wire, detached from the collar on the pipe at 26 and recovered. This allows buoyant upthrust of the buoyancy modules to form the final hogbend shape of the riser.

A disadvantage of the conventional installation method is the requirement for extra vessel operations, in particular the need for an additional support vessel to handle the clump weight. The support vessel is required in view of the high load of the clump weight and the complexity of the installation and recovery manoeuvres.

In this respect, FIG. 2 shows a surface installation exemplified by an FPSO 28 and an installation vessel 30 laying a flexible riser 32, eventually to be handed off to the FPSO 28. The installation vessel 30 adds buoyancy modules 34 to the riser 32 as the riser 32 is launched into the water. A support vessel 36 is shown beside the installation vessel 30 in the process of attaching a clump weight 38 to the riser 32. The installation vessel 30 and the support vessel 36 operate respective ROVs 40 to monitor and to assist with the necessary subsea operations.

The use of the additional support vessel 36 is undesirable for many reasons, notably: operational cost; tie-up of capital assets; reliance on a suitable weather window; and the need to manage safety risks associated with the proximity of the support vessel 36 to the installation vessel 30. Installation is therefore possible only in limited sea states.

Managing safe use of the support vessel 36 complicates and delays the installation process, which adds further to the cost and the risk of disruption due to bad weather. In this respect, FIGS. 3 and 4 show how the riser 32 moves between the surface 42 and the seabed 44 during the steps that are typically involved in, respectively, installing and recovering the clump weight 38. The changing position of the riser 32 is noted by the sequence of suffixes 32A, 32B and so on.

In FIG. 3, the first step of installing the clump weight 38 is to pause laying of the riser 32A and the installation of buoyancy modules 34 onto the riser 32A. Next, layback is increased by the installation vessel 30 paying out the riser 32B and moving forward to make space for the support vessel 36 to approach. The support vessel 36 then connects the clump weight 38 to the riser 32C via a collar 46 on the riser 32C beneath the buoyancy modules 34 and then moves away again. Finally, the installation vessel 30 moves back and lifts the riser 32D to continue laying the riser 32D while installing the buoyancy modules onto the riser 32D.

In FIG. 4, the first step of recovering the clump weight 38 is to pause laying of the riser 32E as the support vessel 36 approaches. Next, the support vessel 36 recovers the clump weight 38 by detaching the clump weight 38 from the collar 46. Consequently, buoyant upthrust of the buoyancy modules 34 forms a hogbend 48 in the riser 32F. Finally, the support vessel 36 moves away before the installation vessel 30 adjusts layback and continues laying the riser 32G.

Typically, installation of a lazy wave riser 32 must be stopped for a period of twelve to sixteen hours for installation of the clump weight 38 and again, for a similar period, for recovery of the clump weight 38. Consequently, the use of a clump weight 38 adds more than a full day to the riser installation operation. This is a costly disadvantage, as the combined daily operating costs of the installation vessel 30 and the support vessel 36 will typically be hundreds of thousands of US dollars. Moreover, the overall cost to the installation project could be very much higher if a suitable weather window is missed as a result of such a delay.

In some specific cases, the pipe section on which the buoyancy modules are installed is so short that its trailing end needs to be passed over the top of a lay tower of the installation vessel to allow an additional length of pipe to be paid out. This manoeuvre is time-consuming and so further increases the length of the riser installation operation.

Another drawback of using an additional support vessel is that it may be necessary to anchor the riser temporarily to the seabed. This is because increasing layback increases the horizontal force acting on the riser at the TDP.

A further disadvantage of the conventional installation method is that once the clump weight is installed on the riser, there is no easy way to control the static load applied by the clump weight to the riser.

The external sheath of a riser of flexible pipe could slip during the lengthy installation operation and especially during removal and recovery of the clump weight while the flexible pipe is clamped between tensioners. The external sheath could also be damaged due to the high top angles required for the installation operation.

WO 2011/099869 and WO 2015/192899 disclose how a lazy wave riser may be installed where a floating platform is already present. This means that a support vessel can be omitted because a crane on the platform can be used as an installation tool instead. In the latter document, the platform is displaced so that the installation vessel can remain at a safe distance from the platform. However, displacement of a platform is often impossible because the platform may not be a floating structure or may already be connected to other risers.

A platform is also employed in WO 2017/095228 and WO 2017/095229 when installing a pliant wave riser. Multiple lines control the transition section where the riser touches down on the seabed, with a sagbend shape. The use of multiple lines increases the risk of clashing or entanglement. Also, as control of the riser shape is lacking, there is a risk of the flexible pipe being damaged.

US 2011/274501 describes a method for assembling an operating rig for a fluid in a body of water.

Against this background, the invention resides in a method of installing a wave-configuration subsea riser. The method comprises: suspending the riser from an installation vessel; suspending an elongate clump weight in a catenary shape comprising first and second limbs extending upwardly from a conjoining bottom portion, with an upper end of the first limb, at a distal end of the clump weight, being attached to the riser and an upper end of the second limb, at a proximal end of the clump weight, being suspended from a winch or crane of the installation vessel; and, while lowering the riser progressively into the sea from the installation vessel, controlling a weight load applied by the clump weight to the riser by adjusting relative lengths of the first and second limbs of the clump weight.

Adjusting the relative lengths of the first and second limbs may involve adjusting relative levels of the distal and proximal ends of the clump weight.

Advantageously, the riser can be lowered continuously or laid on the seabed continuously while the weight load applied to the riser by the clump weight is varied.

Conveniently, a winch or crane of the installation vessel may be used to adjust the relative lengths of the first and second limbs.

The relative lengths of the first and second limbs may be adjusted by adjusting the relative lowering speeds of the riser and of the upper end of the second limb.

The clump weight may be bent along its length around a curve that defines the bottom portion. For example, the clump weight may comprise links like a chain and may be bent by articulation between those links.

The method of the invention may include the preliminary step of attaching the distal end of the clump weight to the riser, for example via a collar of the riser. The distal end of the clump weight may suitably be attached to the riser beneath buoyancy modules that are attached to a hogbend portion of the riser.

Buoyancy modules may conveniently be attached to the hogbend portion of the riser aboard the installation vessel.

Then, the hogbend portion carrying the buoyancy modules may be submerged under tension in the riser, which tension is applied to the riser by the first limb of the clump weight. Thereafter, for example when all buoyancy modules along the hogbend portion have been submerged, tension in the riser may be reduced by shortening the first limb of the clump weight. This allows buoyant upthrust of the submerged buoyancy modules along the hogbend portion to form a hogbend in the riser.

After the hogbend is formed, the clump weight may be detached from the riser and recovered to the installation vessel. More generally, the installation vessel can support the full weight load of the clump weight before, during and after attachment of the clump weight to the riser. Thus, advantageously, the clump weight may be lowered from and recovered to the installation vessel using its winch or crane.

To address the problems of the prior art described above, the invention provides a new methodology for installation, removal and control of the total static load at the clump weight collar of a flexible riser. To do so, the invention handles a clump weight device in a double catenary shape. The clump weight device is connected at one extremity to the clump weight collar, and at the other extremity to a winch or crane onboard the lay vessel. The clump weight device may, for example, be made of mooring chains, a heavy cable or a combination of both.

The invention eliminates the need for support vessels, hence reducing the costs and risks of a riser installation operation. The invention also eliminates the need to stop the pipelay operation to allow installation or recovery of the clump weight device. This saves valuable time.

Fine control of the clump weight during each step of the operation allows the possibility to increase sea state limits. Thus, the invention also allows riser installation operation to take place in significantly higher sea states than is possible in the prior art. The invention also achieves notable reductions in compressive loads experienced by the riser and in the dynamic amplification factor (DAF) and static top tension exerted by the riser.

The same clump weight device can be used for as many trips it is required. Also, there is no need for a temporary anchorage for the riser pipe.

During installation of the buoyancy modules, the installation vessel may deploy the clump weight and connect it to the clump weight collar. The other extremity of the double catenary is connected to a winch or crane onboard the installation vessel.

The total clump weight below the clump weight collar may be adjusted by paying out or winding in a winch wire or crane wire during the operation. The amount of clump weight supported by the clump weight collar may be optimised through analysis for each step of the operation, targeting the maximum allowable significant wave height ($H_s$).

Once the desired lazy wave configuration is achieved during pipelay, the clump weight can be recovered. Disconnection of the clump weight from the clump weight collar may take place whenever is best and most convenient for the operation. The operation does not need to be paused, and there is no need to increase layback.

In summary, the invention solves various problems suffered by prior art techniques for wave-configuration riser installation, notably by reducing the time spent on, and costs of, installation and removal of clump weights, as well as reducing risks involved in the operation.

Embodiments of the invention implement a method to create the hogbend of a wave-configuration flexible riser. The method comprises the following steps: connecting a first end of a clump weight to a winch; lowering the flexible riser and mounting the buoys on the flexible riser while paying out the winch; connecting the second end of the clump weight to the flexible riser below the buoys; lowering the flexible riser and creating the hogbend by simultaneously paying out the flexible pipe and pulling or releasing the clump weight; and disconnecting the second end of the clump weight.

The completed riser may, for example, have a lazy-wave configuration.

The clump weight is suitably elongate and may comprise at least one chain.

A clump weight collar may be coupled to the flexible riser for connecting the clump weight to the flexible riser.

In summary, the invention provides a method of installing a wave-configuration subsea riser of unbonded flexible pipe. The method comprises lowering the riser progressively into the sea from an installation vessel while suspending an elongate clump weight in a catenary shape that comprises first and second limbs extending upwardly from a conjoining bottom portion. An upper end of the first limb, at a distal end of the clump weight, is attached to the riser and an upper end of the second limb, at a proximal end of the clump weight, is suspended from a winch or crane of the vessel. While lowering the riser from the vessel, the weight load applied to the riser by the clump weight is controlled by adjusting the relative lengths of the first and second limbs of the clump weight.

To describe the prior art background, reference has already been made to FIGS. 1 to 4 of the accompanying drawings, in which.

Figure 5:
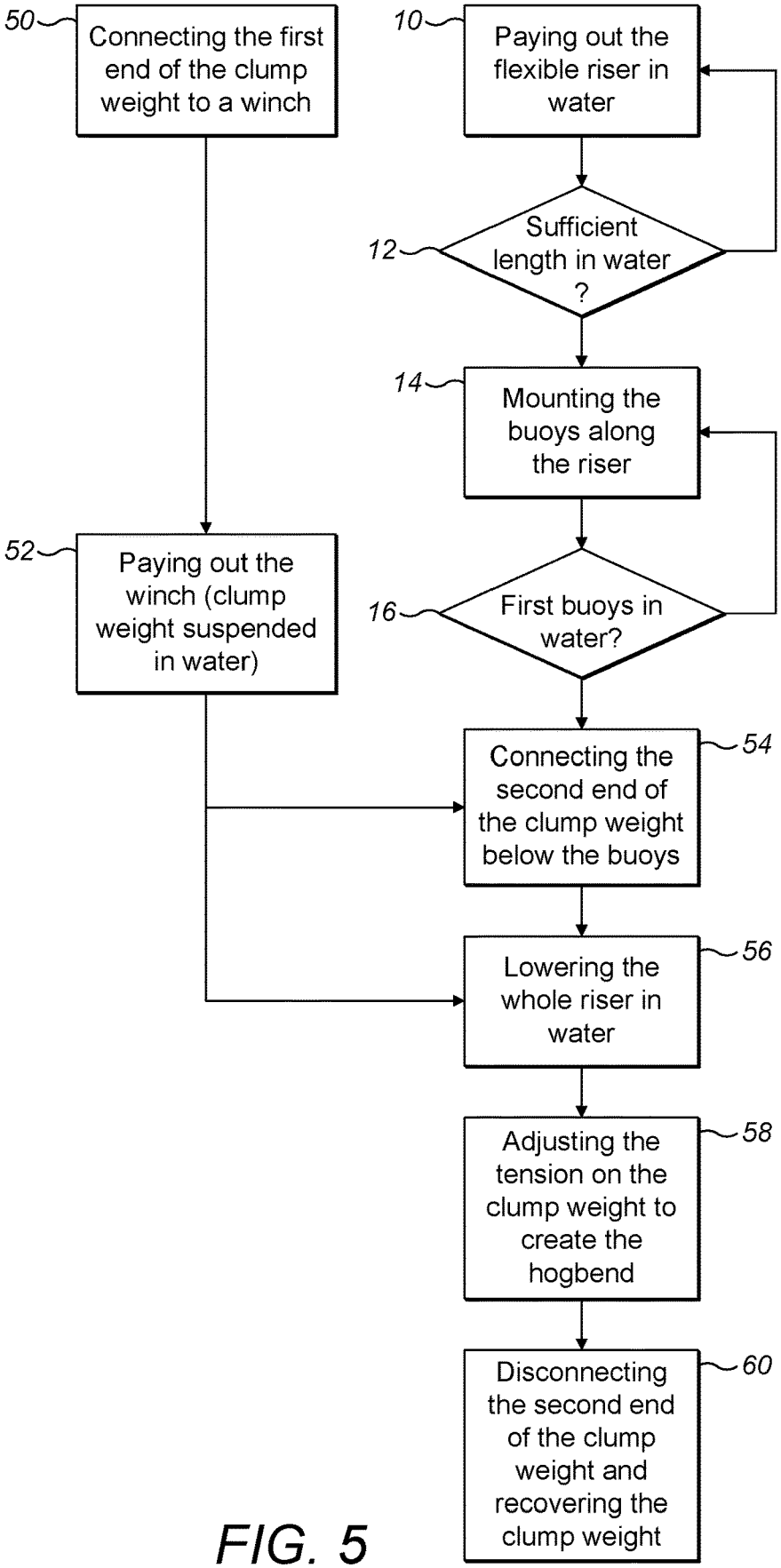

In order that the invention may be more readily understood, reference will now be made, by way of example, to the accompanying drawings in which:

FIG. 5 is a flow diagram of a riser installation method in accordance with the invention; and FIGS. 6 to 10 are a sequence of side views of a pipelay vessel installing a riser in accordance with the method set out in FIG. 5.

The flow diagram of FIG. 5 sets out a method of the invention. Steps 10, 12, 14 and 16 are the same as the correspondingly-numbered steps of the prior art method shown in FIG. 1. Thus, at 10, a riser of flexible pipe is progressively unspooled aboard an installation vessel and launched from that vessel into the sea. When a determination is made, at 12, that a sufficient length of the riser has been launched into the sea, initial buoyancy modules are mounted to the riser, at 14, spaced along a hogbend portion of the riser that will form the desired hogbend. The hogbend portion may, for example, be a few hundred metres long. Lowering of the riser continues until, at 16, a determination is made that the leading buoyancy modules are underwater.

Figure 1:
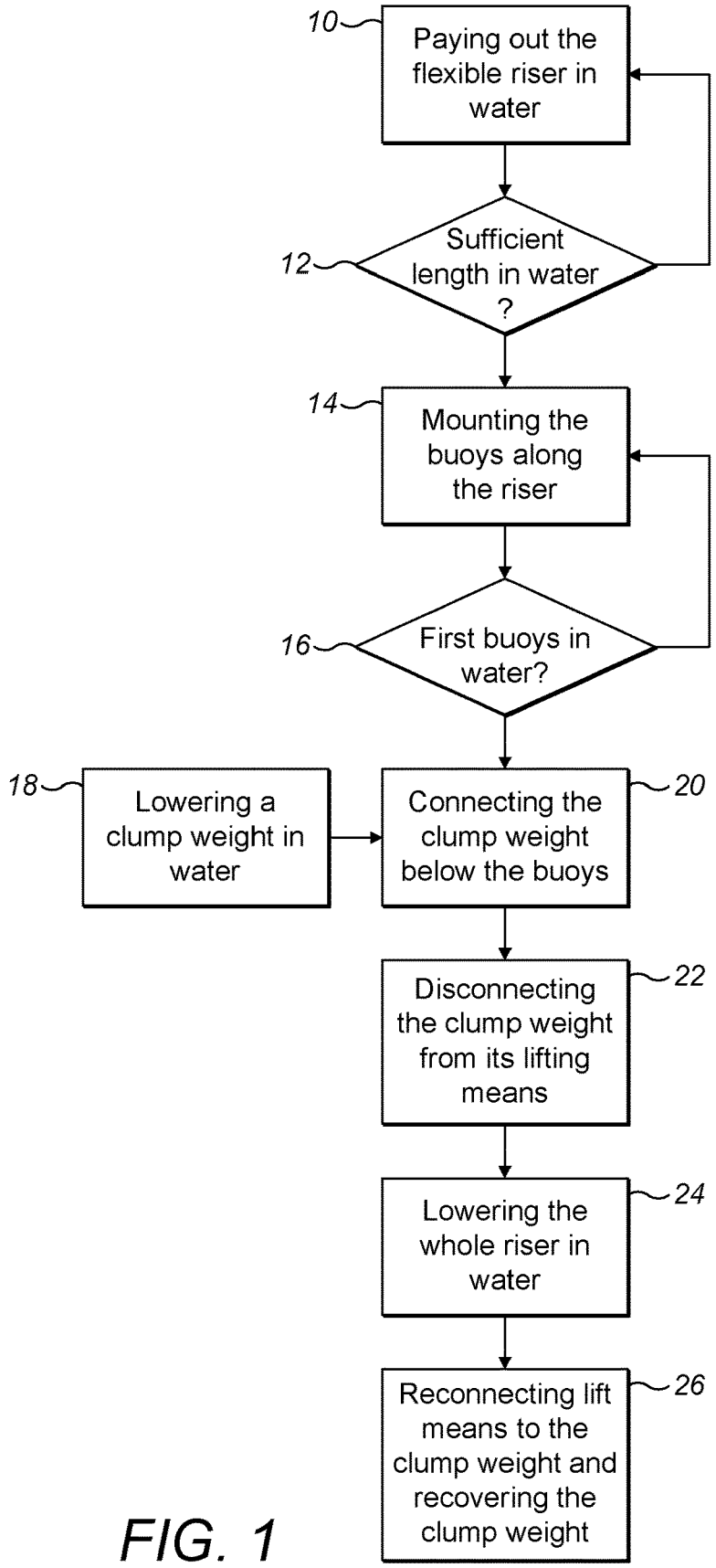
FIG. 1 Prior Art
FIG. 1 is a flow diagram of a prior art method for installing a riser.
Figure 2:
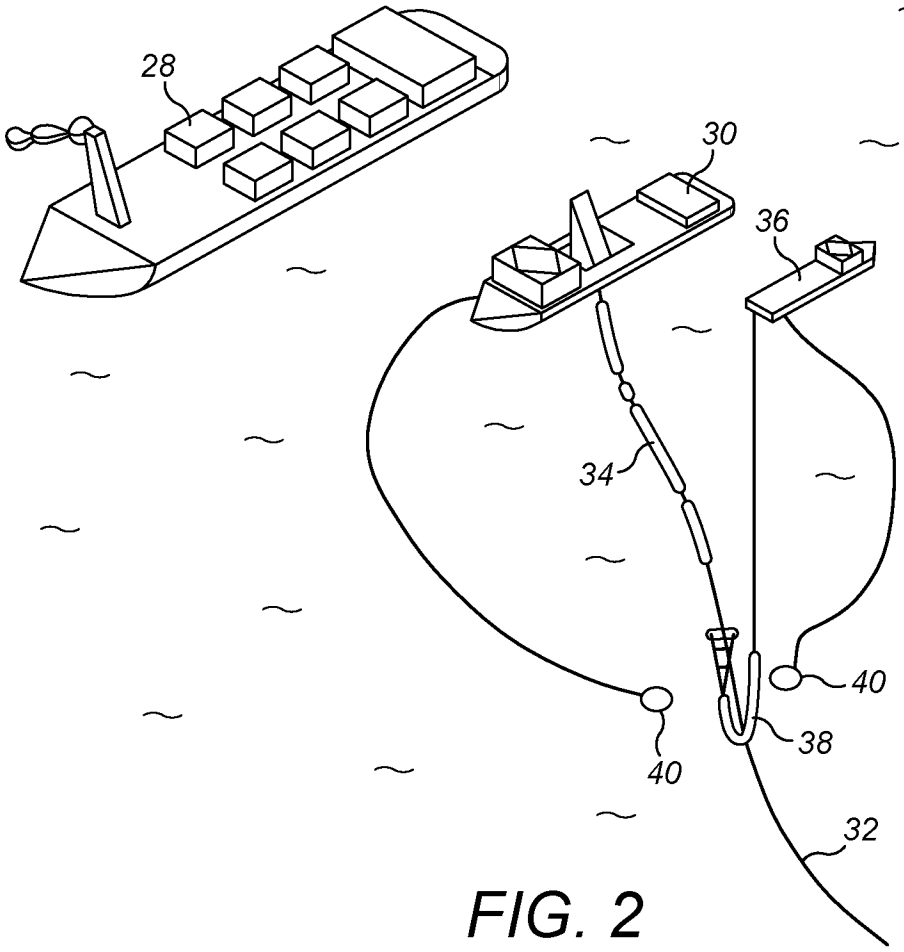
FIG. 2 Prior Art
FIG. 2 is a schematic perspective view of a pipelay vessel and a support vessel in the process of installing a riser for connection to an FPSO, using a method of installing or recovering a clump weight as set out in FIG. 1.
Figure 3:
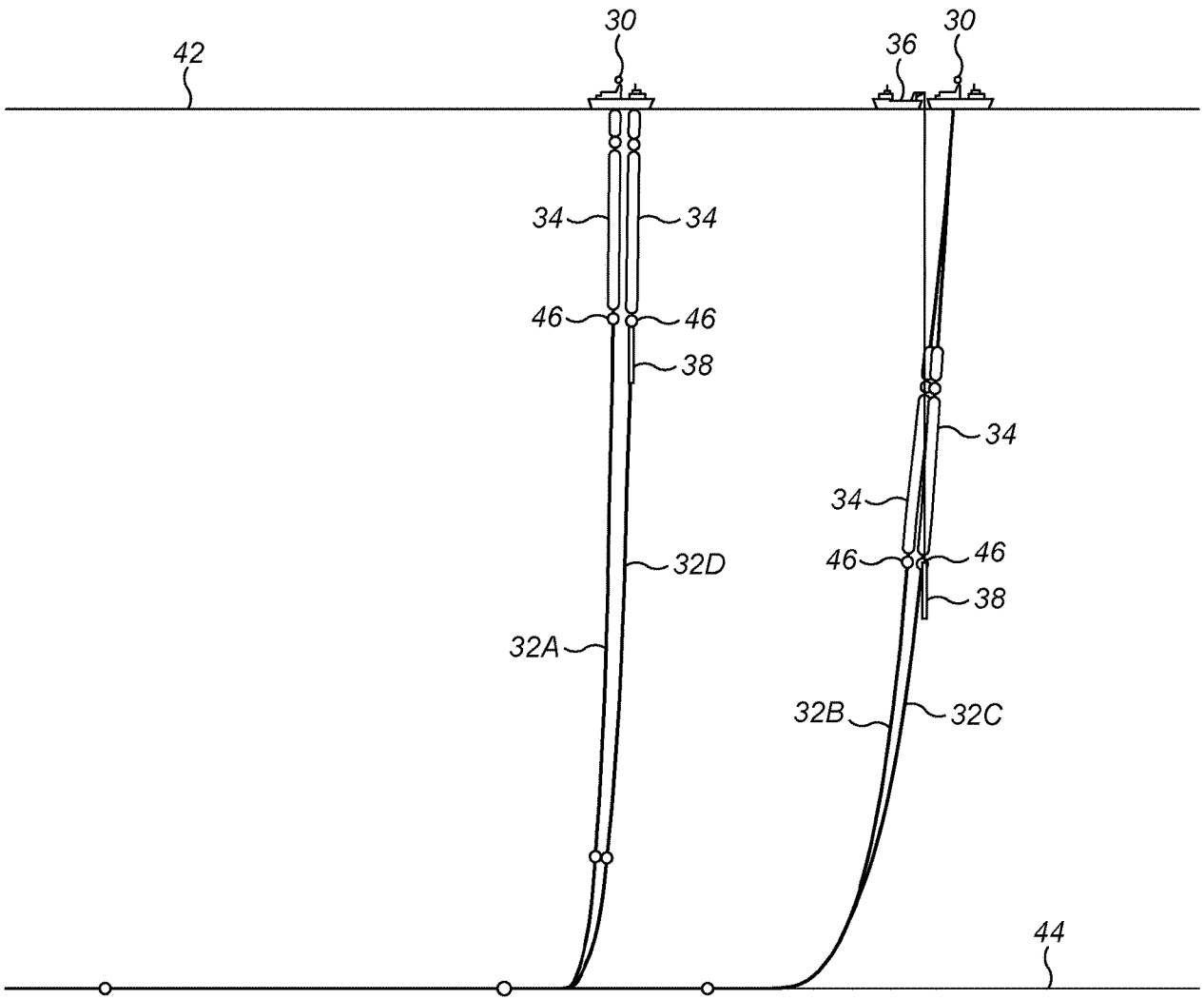
FIG. 3 Prior Art
FIG. 3 is a side view that exemplifies movement of the riser in the water column through typical steps of clump weight installation as known in the prior art.
Figure 4:
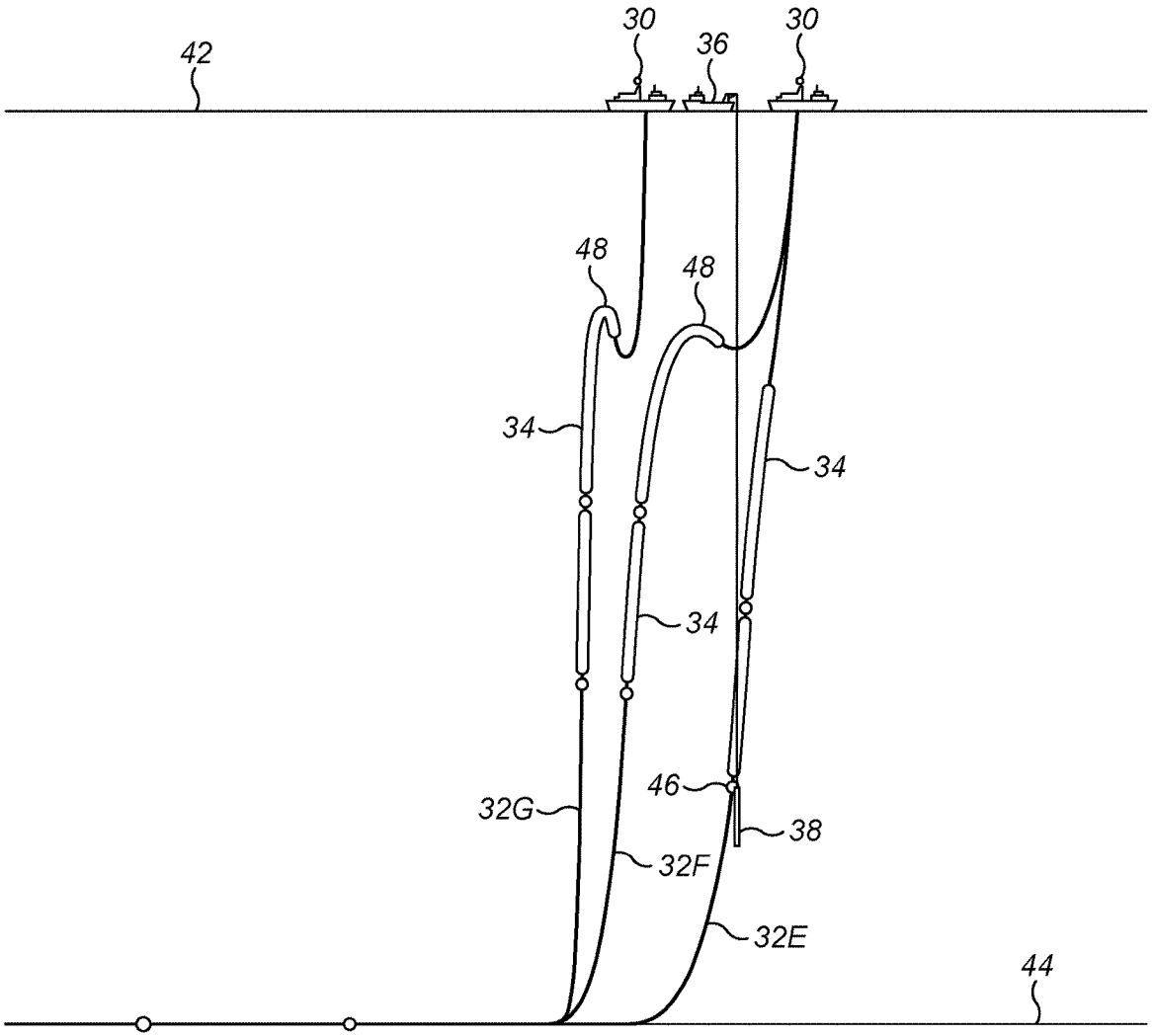
FIG. 4 Prior Art
FIG. 4 corresponds to FIG. 3 but exemplifies movement of the riser in the water column through typical steps of clump weight recovery as known in the prior art.

The method shown in FIG. 5 differs from that shown in FIG. 1 in that, at 50, a first, proximal end of an elongate clump weight is connected to a winch aboard the installation vessel. Then, after paying out the winch wire at 52 to suspend the clump weight in water beneath the installation vessel, an opposed second, distal end of the clump weight is connected to the collar of the riser beneath the submerged leading buoyancy modules at 54.

The winch wire is paid out further as the pipe, with buoyancy modules attached along the hogbend portion, is lowered further in the water at 56.

On being attached to the riser, the clump weight applies a weight load to the riser. By virtue of the invention, that weight load is gradually increased to maintain tension in the riser and to overcome the increasing aggregate buoyant upthrust as more of the buoyancy modules are pulled underwater with the downwardly-advancing riser.

When the buoyancy modules along the hogbend portion of the riser have all been pulled underwater on the riser and have reached the appropriate depth, the weight load applied by the clump weight to the riser is gradually reduced. To do so, the weight load of the clump weight is transferred progressively from the riser to the winch wire, hence causing tension in the winch wire to increase.

Reducing the weight load applied to the riser in this way allows buoyant upthrust of the buoyancy modules along the hogbend portion to form the desired hogbend in the riser at 58.

When formation of the hogbend is complete, the distal end of the clump weight is detached from the riser at 60 so that the clump weight can be lifted back to the installation vessel.

The method set out in FIG. 5 will now be explained in more detail with reference to FIGS. 6 to 10 of the drawings, in which like numerals are used for like features.

FIGS. 6 to 10 show an installation vessel 30 on the surface 42 in the process of laying a riser 32 of flexible pipe. The riser 32 extends from the surface 42 to the seabed 44. These drawings are not to scale: in practice, the depth of the water between the surface 42 and the seabed 44 will typically be much greater than is shown here.

As is conventional, the installation vessel 30 comprises a pipe storage facility in the form of under-deck carousels 62 in this example, an upright lay tower 64 and an abandonment and recovery (A&R) winch 66.

The flexible pipe of the riser 32 is stored in one or both of the carousels 62 in a coiled arrangement before being lifted to an intermediate level of the lay tower 64. From there, the riser 32 is launched downwardly into the water on an upright launch axis, for example through a moonpool in the hull of the installation vessel 30.

As is also conventional, the lay tower 64 comprises a tensioner system that supports the suspended weight of the riser 32 while controlling downward movement of the riser 32 along the launch axis. If needs be, the lay tower 64 can be tilted from the vertical so that the launch axis has corresponding inclination. Buoyancy modules 34 are fixed to the riser 32 aboard the installation vessel 30 as the riser 32 is launched into the water.

FIGS. 6 to 10 also show an elongate, flexible clump weight 38 that is bendable along its length. In this example, the clump weight 38 comprises articulated links in the form of a heavy chain. A proximal end of the clump weight 38 is suspended from the A&R winch 66 on an A&R wire 68. Conversely, a distal end of the clump weight 38 is suspended from a collar 46 or other support structure on the riser 32.

The effect of suspending the clump weight 38 from its ends in this way is to hang the clump weight 38 in a catenary shape from both the lay tower 64 and the A&R winch 66 of the installation vessel 30. The installation vessel 30 supports the full weight load of the clump weight 38 throughout but that load is shared between the tensioners of the lay tower 64 and the A&R winch 66.

By sharing the weight load of the clump weight 38 between the lay tower 64 and the A&R winch 66 in varying ratios, the invention allows continuous fine control of the weight load that is applied by the clump weight 38 to the riser 32, without interruption, throughout the riser installation operation. Also, as the clump weight 38 is always supported by the installation vessel 30, there is no need for an additional support vessel to handle the clump weight 38 or, therefore, for interrupting the riser installation operation to allow for the approach of such a vessel.

The catenary shape of the clump weight 38 comprises first and second limbs 70, 72 that extend upwardly from a conjoining bottom portion 74. An upper end of the first limb 70, at the distal end of the clump weight 38, is attached to the riser 32 via the collar 46. Conversely, an upper end of the second limb 72, at a proximal end of the clump weight 38, is suspended from the A&R winch 66 via the A&R wire 68.

While lowering the riser 32 from the installation vessel 30, the weight load applied by the clump weight 38 to the riser 32 may be adjusted continuously by adjusting the relative lengths of the first and second limbs 70, 72 of the clump weight 38. Thus, there is a corresponding change in the relative levels of the distal and proximal ends of the clump weight 38. To allow this change, the clump weight 38 bends around a curve that defines the bottom portion 74 and is moved longitudinally in either direction around that curve. In this respect, reference is made to FIGS. 6 and 7.

Figure 6:
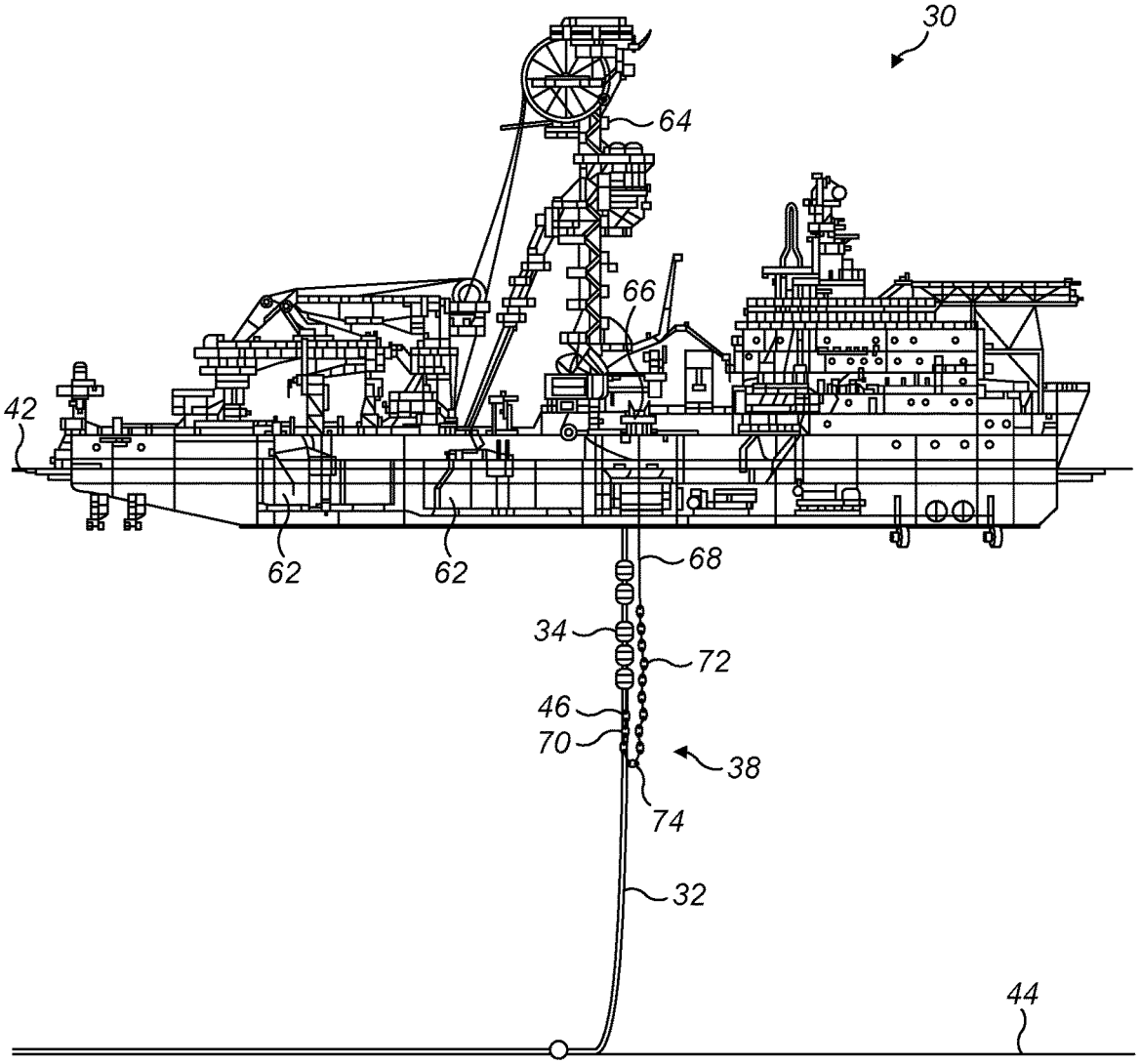
Figure 7:
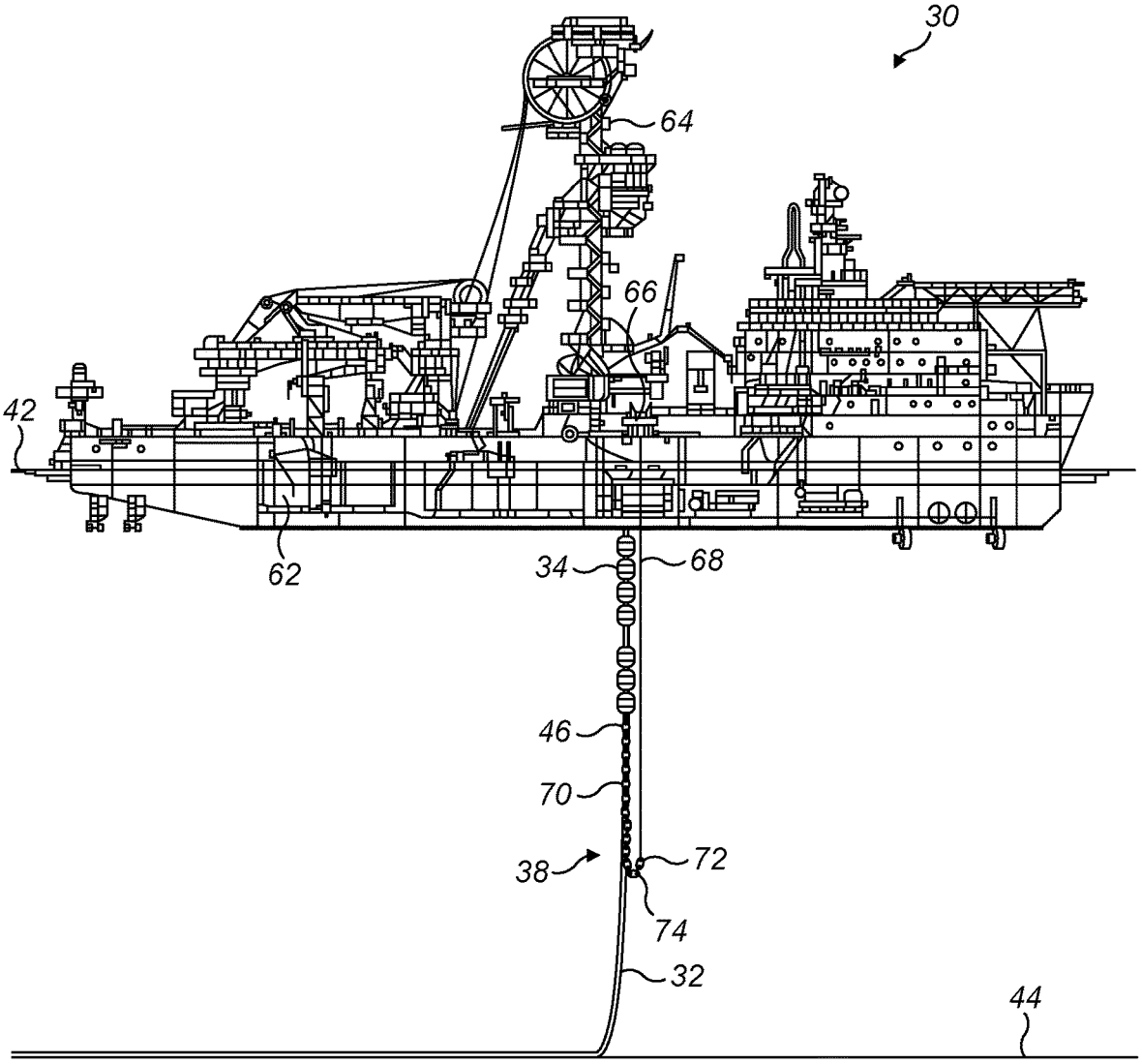

Adjustment of the weight load applied by the clump weight 38 to the riser 32 may be achieved in various ways. For example, the A&R wire 68 may be paid out more quickly than the riser 32 is lowered by the tensioners on the lay tower 64, which increases the length of the first limb 70 of the clump weight 38 and so applies a greater weight load to the riser 32 as tension in the A&R wire 68 decreases. This is shown in FIG. 7. Conversely, the first limb 70 of the clump weight 38 may be shortened by lowering the riser 32 more quickly than the A&R wire 68 is paid out. This reduces the weight load applied by the clump weight 38 to the riser 32, and correspondingly increases the tension in the A&R wire 68 as the second limb 72 of the clump weight 38 lengthens. This is shown in FIG. 6.

It will be apparent that similar adjustments could be made by moving the riser 32 when the A&R wire 68 is stationary or vice versa, or indeed by reversing the direction of the riser 32 or the A&R wire 68 to lift them temporarily toward the installation vessel 30.

In practice, the weight load of the clump weight 38 is borne exclusively by the A&R winch 66 until the distal end of the clump weight 38 is attached to the collar 46 of the riser 32. Then, some of the weight load of the clump weight 38 is transferred gradually to the riser 32 as shown in FIG. 6. This maintains tension in the riser 32 by counterbalancing the buoyant upthrust of the submerged buoyancy modules 34. As the riser 32 is lowered further into the water and more of the buoyancy modules 34 are submerged as a result, more of the weight load of the clump weight 38 is transferred gradually to the riser 32, as shown in FIG. 7. This offsets the increasing aggregate buoyant upthrust of the buoyancy modules 34.

Figure 8:
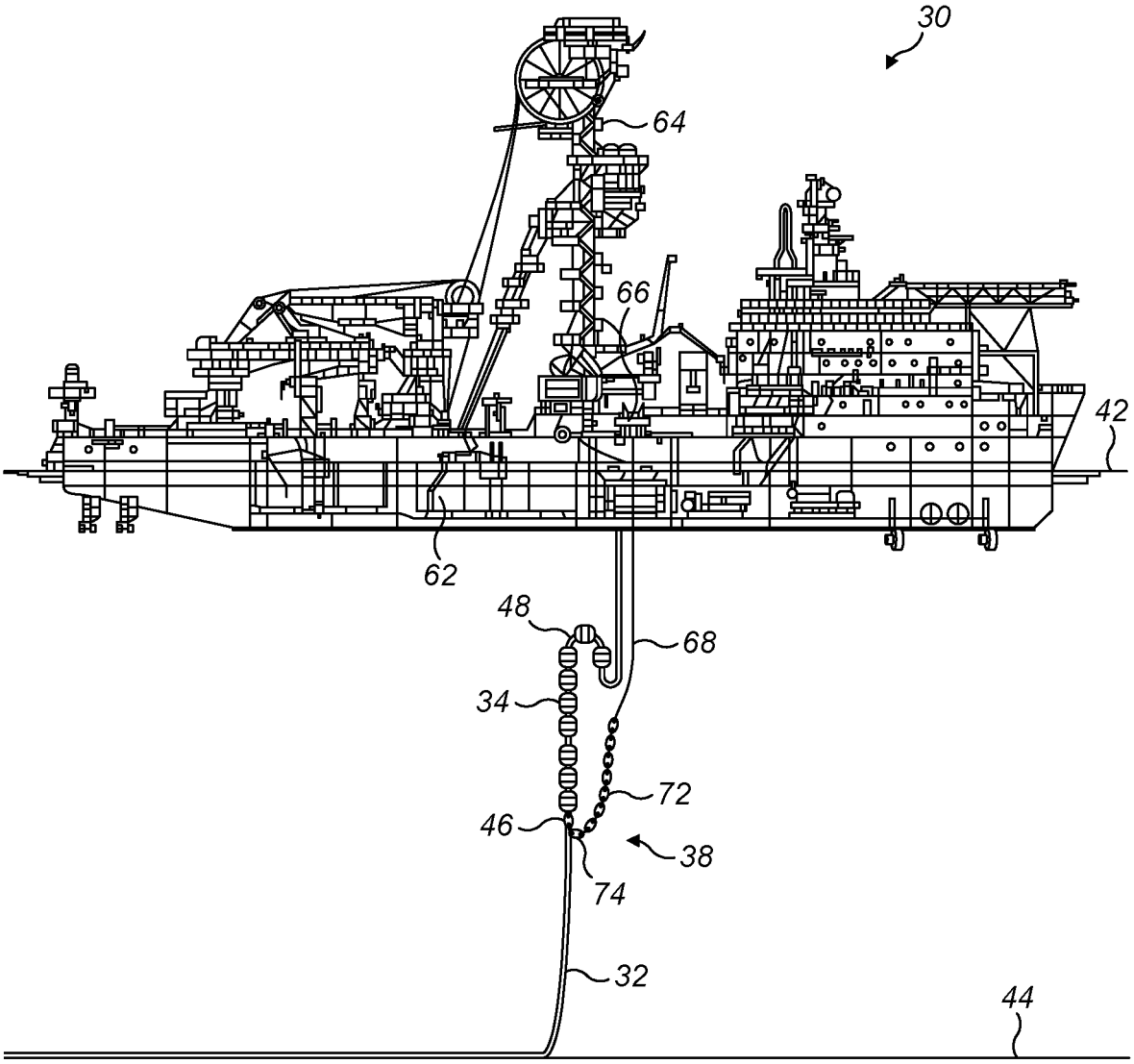
Figure 9:
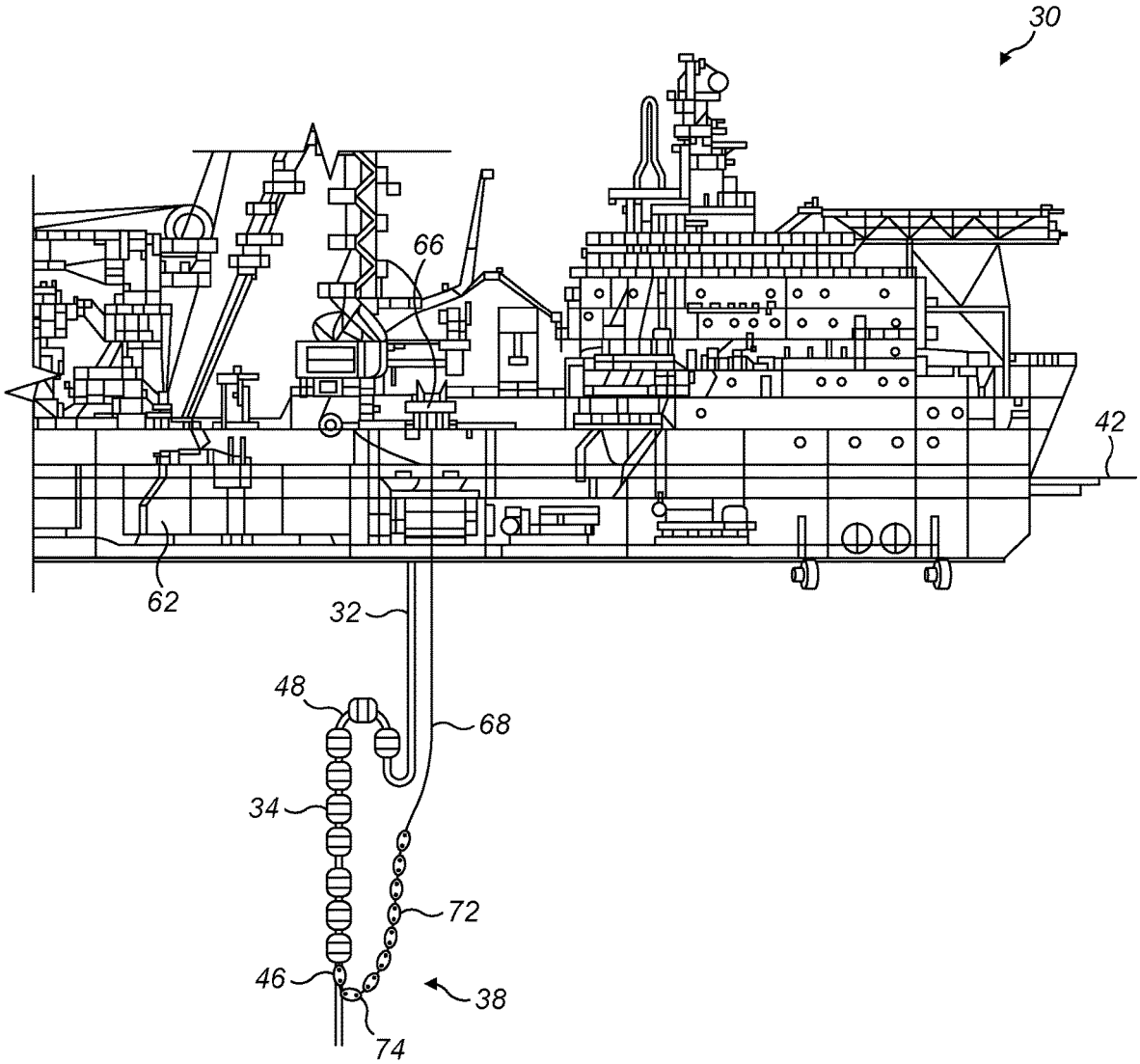

When all of the buoyancy modules 34 required to support the hogbend 48 have been pulled underwater on the riser 32 and have reached the appropriate depth, the weight load applied by the clump weight 38 to the riser 32 is gradually reduced. This is done by gradually transferring most of the weight load of the clump weight 38 back from the riser 32 to the A&R wire 68, for example by pulling up the A&R wire 68. This allows the buoyant upthrust of the buoyancy modules 34 to initiate the hogbend 48 in the riser 32 as shown in FIG. 8 and in enlarged form in FIG. 9.

When the A&R wire 68 has resumed carrying the full weight load of the clump weight 38, the distal end of the clump weight 38 can be detached from the collar 46 of the riser 32. The clump weight 38 can then be recovered to the installation vessel 30 for possible re-use on other risers.

Figure 10:
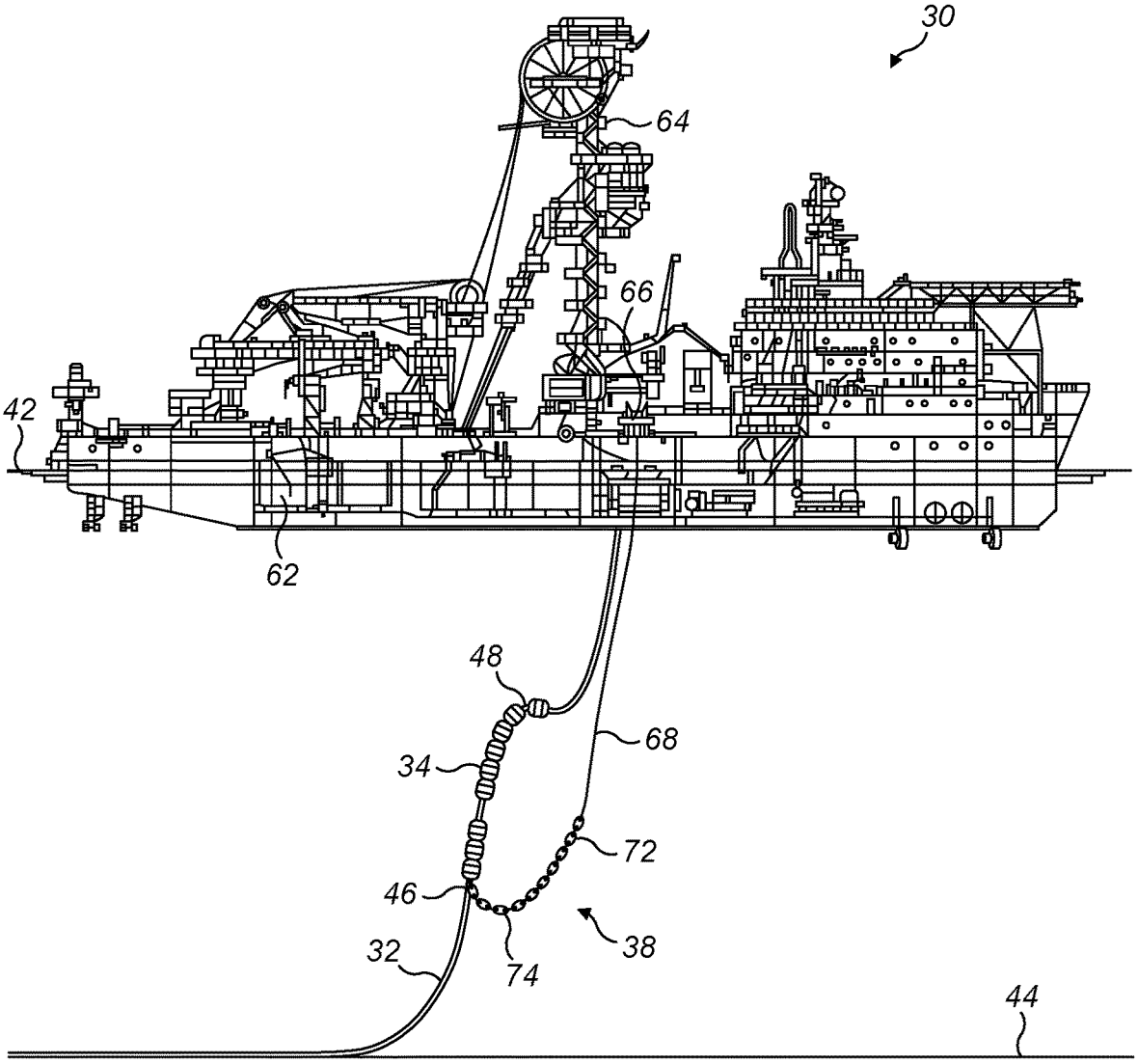

Conveniently, the clump weight 38 can be detached from the riser 32 at any stage, without requiring the riser installation operation to be interrupted. For example, FIG. 10 shows the clump weight 38 still attached to the riser 32, with a minor portion of its weight load borne by the riser 32, as the installation vessel 30 advances to continue laying the riser 32 and to continue forming the final lazy-wave shape of the riser 32 including the hogbend 48.

Many variations are possible within the inventive concept. For example, the clump weight could be supported by a crane of the installation vessel rather than by a winch.

The invention claimed is:

1. A method of installing a wave-configuration subsea riser, the method comprising:

suspending the riser from an installation vessel;

suspending an elongate clump weight in a catenary shape comprising first and second limbs extending upwardly from a conjoining bottom portion, with an upper end of the first limb, at a distal end of the clump weight, being attached to the riser and an upper end of the second limb, at a proximal end of the clump weight, being suspended from a winch or crane of the installation vessel; and while lowering the riser progressively into the sea from the installation vessel, controlling a weight load applied by the clump weight to the riser by adjusting relative lengths of the first and second limbs of the clump weight;

the method further comprising attaching buoyancy modules to a hogbend portion of the riser aboard the installation vessel.

2. The method of claim 1, comprising using the winch or crane to adjust the relative lengths of the first and second limbs.

3. The method of claim 1, comprising adjusting the relative lengths of the first and second limbs by adjusting relative lowering speeds of the riser and of the upper end of the second limb.

4. The method of claim 1, comprising bending the clump weight along its length around a curve that defines the bottom portion.

5. The method of claim 4, comprising bending the clump weight by articulation between links of the clump weight.

6. The method of claim 1, comprising attaching the distal end of the clump weight to the riser.

7. The method of claim 6, comprising attaching the distal end of the clump weight to the riser via a collar of the riser.

8. The method of claim 1, further comprising submerging the hogbend portion, carrying the buoyancy modules, under tension in the riser applied to the riser by the first limb of the clump weight.

9. The method of claim 8, comprising reducing tension in the riser by shortening the first limb of the clump weight, allowing buoyant upthrust of the submerged buoyancy modules along the hogbend portion to form a hogbend in the riser.

10. The method of claim 1, comprising attaching the distal end of the clump weight to the riser beneath the buoyancy modules that are attached to the hogbend portion of the riser.

11. The method of claim 1, comprising laying the riser on the seabed continuously while varying the weight load applied to the riser by the clump weight.

12. The method of claim 1, comprising adjusting the relative lengths of the first and second limbs by adjusting relative levels of the distal and proximal ends of the clump weight.

13. The method of claim 1, wherein the installation vessel supports the full weight load of the clump weight before, during and after attachment of the clump weight to the riser.

14. The method of claim 13, wherein the clump weight is lowered from and recovered to the installation vessel using the winch or crane of the installation vessel.

15. The method of claim 1, further comprising detaching the clump weight from the riser and recovering the clump weight to the installation vessel.

* * * * *